US007320182B1

(12) United States Patent
Hsu

(10) Patent No.: US 7,320,182 B1
(45) Date of Patent: Jan. 22, 2008

(54) DEHUMIDIFYING HANGER

(76) Inventor: Tsang-Hung Hsu, 14 Floor, No. 632, Ta-Yu Road, Taoyuan City (TW)

( * ) Notice: Subject to any disclaimer, the term of this patent is extended or adjusted under 35 U.S.C. 154(b) by 0 days.

(21) Appl. No.: 11/521,041

(22) Filed: Sep. 15, 2006

(51) Int. Cl.
*F26B 19/00* (2006.01)

(52) U.S. Cl. ..... 34/90

(58) Field of Classification Search ..... 34/90; 223/94

See application file for complete search history.

(56) References Cited

U.S. PATENT DOCUMENTS 5,907,908 A * 6/1999 Cunanan et al. ..... 34/61
6,716,276 B2 * 4/2004 Loop et al. ..... 96/117.5
2005/0274751 A1 * 12/2005 Plumley et al. ..... 223/85

* cited by examiner

*Primary Examiner*—S. Gravini

(57) ABSTRACT

A dehumidifying hanger includes a hanger frame having perforations formed therein, and a dehumidifying perforated crossbar formed as a hollow tube or pipe and transversely hung under the hanger frame, having desiccant or dehydrating agent filled in the perforated crossbar for absorbing moisture carried or existing in the clothes for drying the clothes in situ in the hanger, without requiring any costly electric drying apparatus or equipment.

4 Claims, 3 Drawing Sheets

Fig. 3
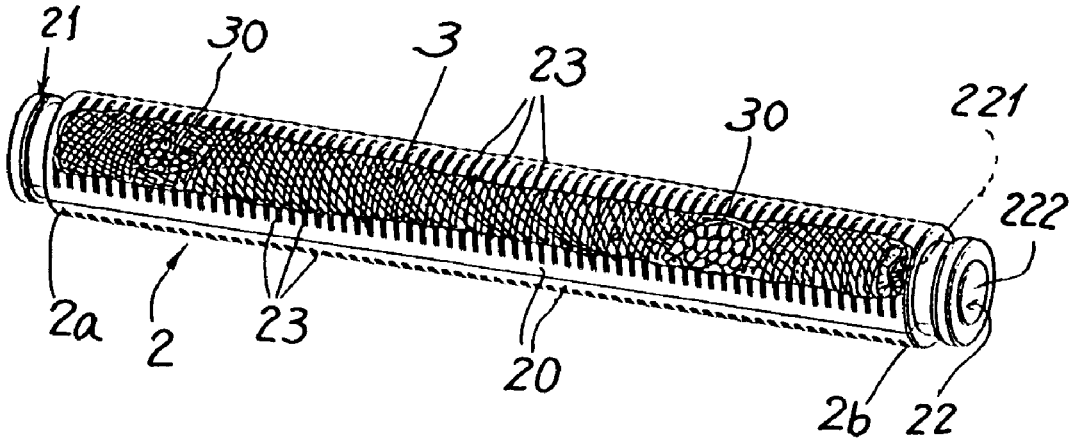
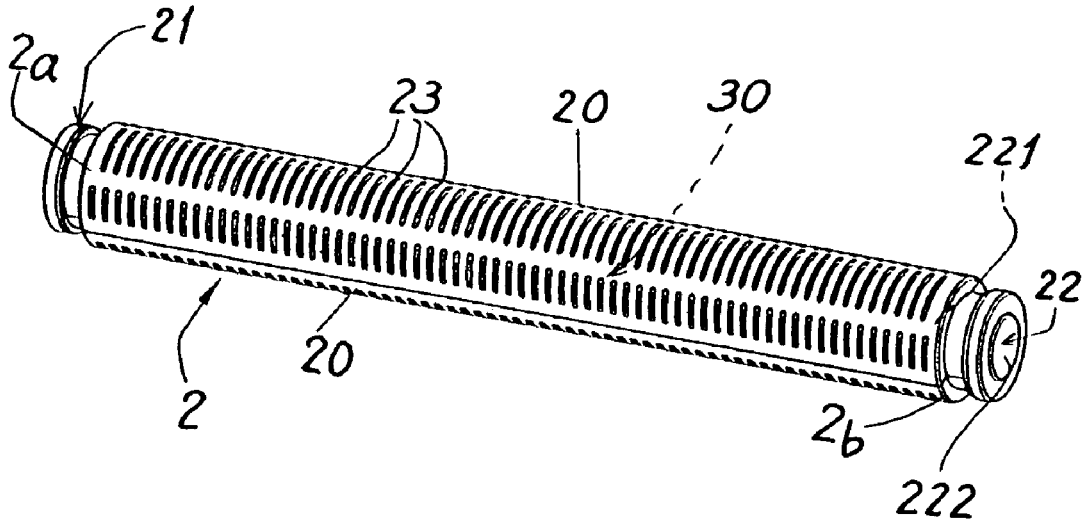
Fig. 4

DEHUMIDIFYING HANGER

BACKGROUND OF THE INVENTION

U.S. Pat. No. 6,185,834 disclosed a centrifugally rotating type clothes drying hanger structure including a motor for rotating the hanger for drying the clothes due to the wind-drying effect caused by rotation-induced airflow.

However, such a prior art has the following drawbacks:

1. A big housing is required for accommodating the plurality of hangers for hanging clothes thereon, increasing the installation and operation cost.
2. Electric motor should be provided for drying the clothes, thereby wasting the electric energy.
3. If the air has a high humidity, the airflow may not dry the clothes efficiently.

The present inventor has found the drawbacks of the prior art and invented the present dehumidifying hanger.

SUMMARY OF THE INVENTION

The object of the present invention is to provide a dehumidifying hanger including a hanger frame having perforations formed therein, and a dehumidifying perforated crossbar formed as a hollow tube or pipe and transversely hung under the hanger frame, having desiccant or dehydrating agent filled in the perforated crossbar for absorbing moisture carried or existing in the clothes for drying the clothes in situ in the hanger, without requiring any costly electric drying apparatus or equipment.

BRIEF DESCRIPTION OF THE DRAWINGS

FIG. 3 is a partially cut-away crossbar of the present invention.

FIG. 4 shows another preferred embodiment of the crossbar of the present invention.

DETAILED DESCRIPTION

Figure 1:
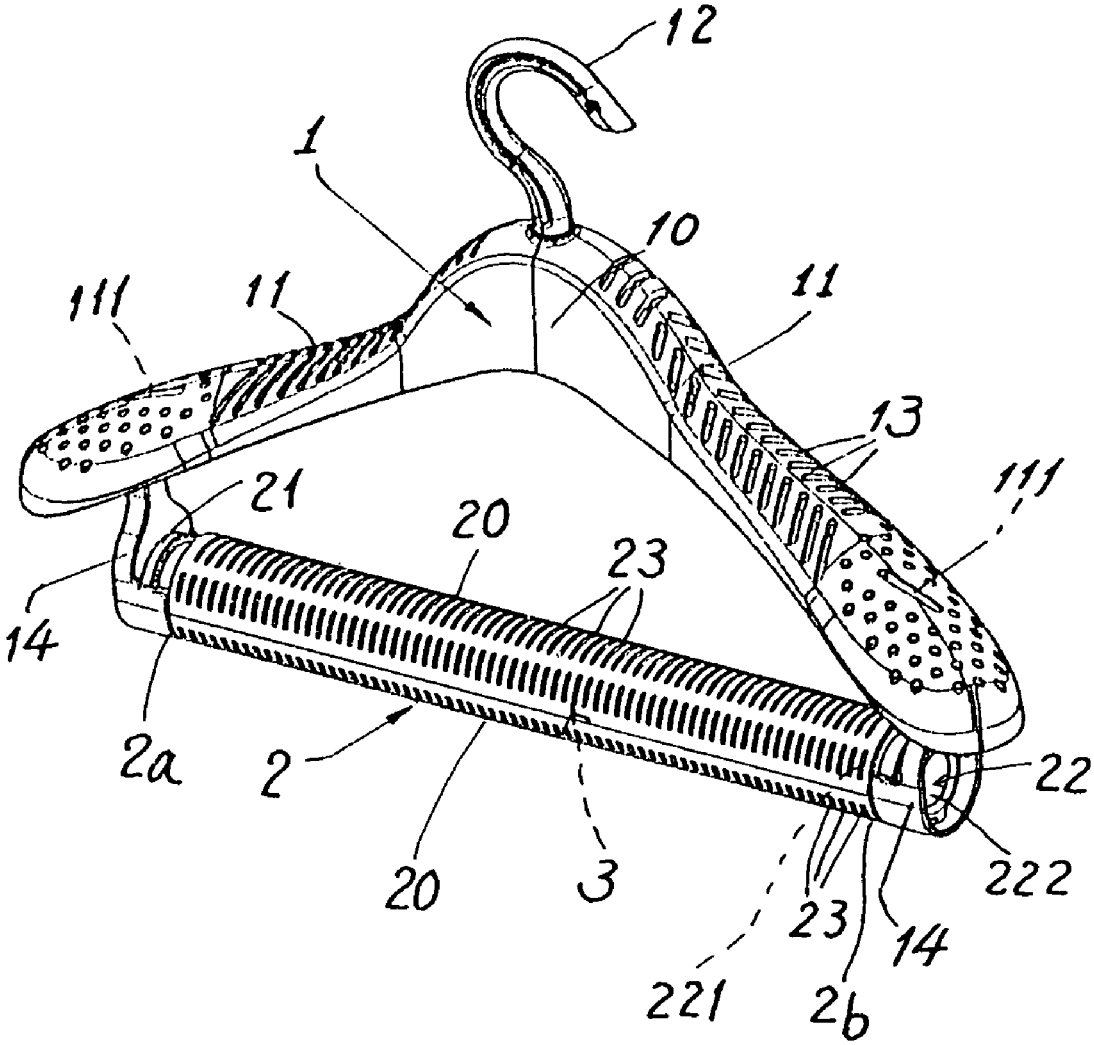
FIG. 1 is a perspective view of the present invention.
Figure 2:
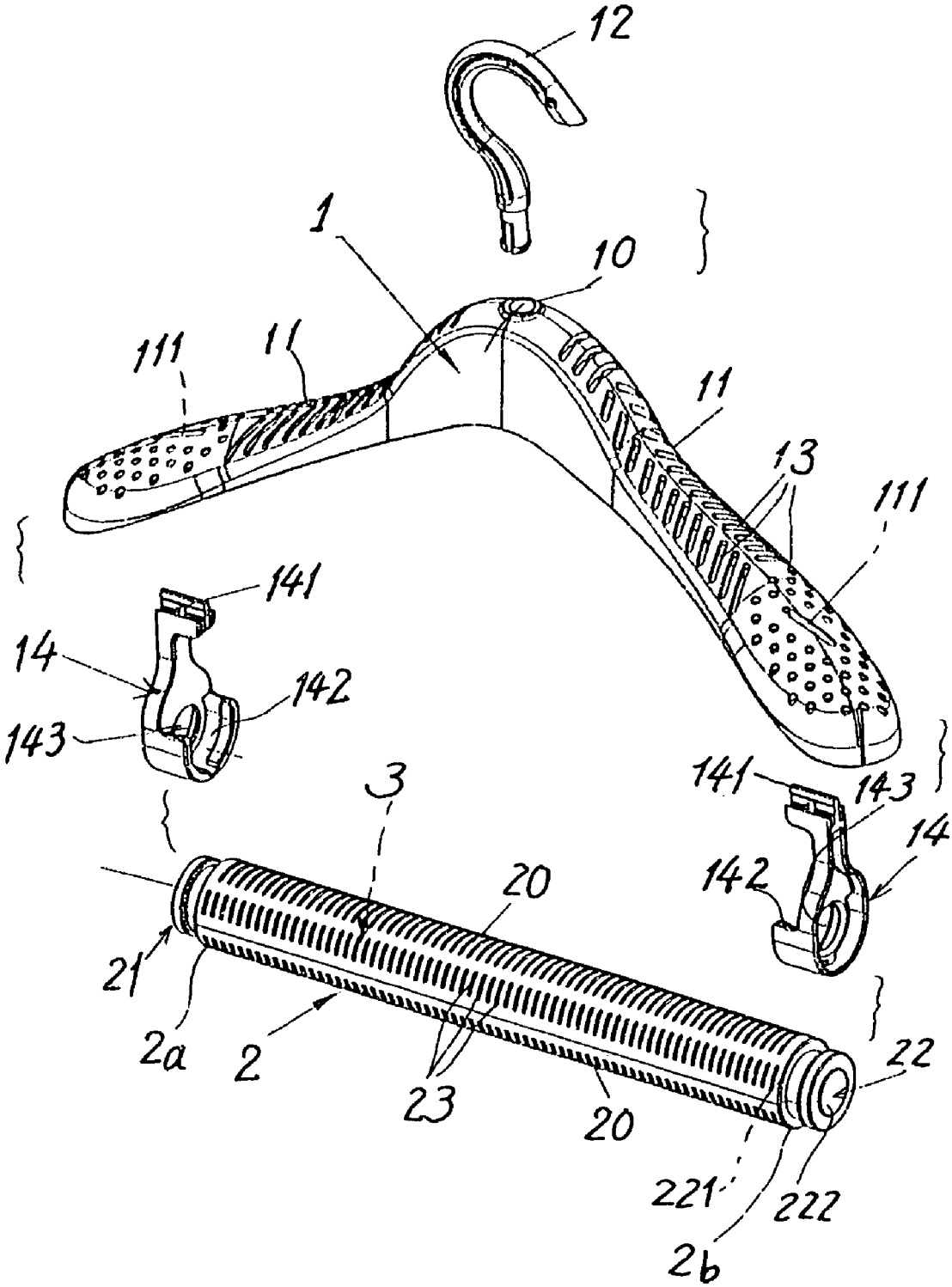
FIG. 2 is an exploded view showing the elements of the present invention.

As shown in FIGS. 1~3, a dehumidifying hanger of the present invention comprises: a hanger frame 1, and a dehumidifying perforated crossbar 2 formed as a hollow tube or pipe and transversely formed on a lower portion of the hanger frame 1, and a desiccant sac 3 filled, stored or inserted in the perforated crossbar 2; having desiccant or dehydrating agent 30 (such as silica gel) filled in the sac 3.

The hanger frame 1 includes: a pair of arm members 11 bifurcated from a central neck portion 10, a hook 12 formed on a top of the central neck portion 10 for hanging purpose, a plurality of perforations 13 formed in the arm members 11 for well ventilation through the perforations 13, and a pair of brackets 14 formed on opposite end portions 111 of the pair of arm members 11 for hanging, securing or embedding the perforated crossbar 2 on the pair of brackets 14.

Each bracket 14 includes a latch 141 engaged in the end portion 111 of each arm member 11, a clip 142 secured to the latch 141 for holding one end portion of the perforated crossbar 2, and a side opening 143 formed in a side portion of the bracket 14 adapted for viewing an interior in the crossbar 2.

The dehumidifying perforated crossbar 2 includes two plugs 21, 22 respectively inserted in opposite ends 2*a*, 2*b* of the crossbar 2 for sealing the desiccant sac 3 in an interior in the crossbar 2, and a plurality of ventilation holes 23 formed through the crossbar 2 for providing passages of moisture-laden airflow or air streamflow through the holes 23 for absorbing the moisture by the desiccant 30 as filled in the sac 3.

The perforated crossbar 2 may be formed with a pair of half shells 20, 20 which may be combined by any conventional methods.

One plug 22 of the two plugs 21, 22 may be formed as a maintenance indicator 22 which includes: a capsule 221 having desiccant 30 filled in the capsule 221 and fluidically communicated with an interior in the sac 3 in the perforated crossbar, and a color-change indicator (e.g., cobalt chloride) impregnated in the desiccant; and an inspection window 222 formed on an outer side wall of the capsule 221 adapted for checking any color change in the capsule, whereby upon visual observation of color change in the capsule 221 through the window 222, it will remind the user to regenerate or renew the desiccant 30 as filled in the sac 3 for ensuring a satisfactory dehumidification for the clothes as hung on the hanger of the present invention.

The clothes as hung by the hanger of the present invention will be always kept dry since the moisture existing in the clothes will be absorbed by the desiccant 30 as filed n the sac 3 in the perforated crossbar 2. Once the moisture absorption is saturated by checking the maintenance indicator 22 formed on the plug 22, the desiccant 30 may be replaced with new one; or the desiccant 30 is regenerated by heating the desiccant such as being heated by an electric heater or dryer in order for re-use of the desiccant 30.

The desiccant sac 3 may be made of air-permeable cover such as fabric, cotton cloth or net material having fine mesh and air penetration property for storing the desiccant 30 in the sac 3.

As shown in FIG. 4, the sac 3 is eliminated and the perforated crossbar 2 is directly filled with desiccant 30 in the crossbar 2.

In such a modification, the holes 23 should be made as small as possible to preclude the releasing or loss of desiccant 30 through the holes 23. Other means may be provided for preventing from loss of desiccant from the crossbar such as by encasing an air-permeable paper around the desiccant within the crossbar 2.

The prevent invention has the following advantages superior to the prior art:

1. The desiccant 30 as filled in the perforated crossbar 2 will absorb the moisture as existing in the clothes hung on the hanger, so that the clothes can be dehumidified in situ in the hanger.
2. Each dehumidifying hanger may be provided for dehumidifying or drying each set of individual clothes, without requiring a conventional big drying house.
3. No electric energy is required for normally drying the clothes as hung on this hanger for saving electric energy.
4. The moisture as carried in the clothes will be efficiently absorbed, regardless of the high humidity in the environment.

The crossbar 2 as designated in this application is a common name, which however is formed as a hollow tube or pipe for filling the desiccant therein.

The present invention may be modified without departing from the spirit and scope of the present invention.

I claim:

1. A dehumidifying hanger comprising:

a hanger frame; and a dehumidifying perforated crossbar formed as a hollow tube and hung under the hanger frame; said perforated crossbar including two plugs respectively inserted in opposite ends of the crossbar for sealing a desiccant sac in an interior in the crossbar, and a plurality of ventilation holes formed through the crossbar for providing passages of moisture-laden air streamflow through the holes for absorbing the moisture by desiccant as filled in the desiccant sac; and one said plug of the two plugs formed as a maintenance indicator, which includes: a capsule having desiccant filled in the capsule and fluidically communicated with an interior in the perforated crossbar, and a color-change indicator impregnated in the desiccant; and an inspection window formed on an outer side wall of the capsule adapted for checking any color change in the capsule, whereby upon visual observation of color change in the capsule through the window, it will remind an user to regenerate or renew the desiccant as filled in the crossbar.

2. A hanger according to claim 1, wherein said hanger frame includes: a pair of arm members bifurcated from a central neck portion, a hook formed on a top of the central neck portion, a plurality of perforations formed in the arm members for well ventilation through the perforations, and a pair of brackets formed on opposite end portions of the pair of arm members for securing the perforated crossbar on the pair of brackets of the hanger frame.

3. A hanger according to claim 2, wherein each said bracket includes a latch engaged in an end portion of each said arm member, a clip secured to the latch for holding an end portion of the perforated crossbar, and a side opening formed in a side portion of the bracket.

4. A hanger according to claim 1, wherein said perforated crossbar is combinably formed with a pair of half shells.

* * * * *